US008495777B1

(12) United States Patent
Dixon

(10) Patent No.: US 8,495,777 B1
(45) Date of Patent: Jul. 30, 2013

(54) RESCUE PUNCH FOR DIVER KNIFE

(76) Inventor: Scott E. Dixon, Long Beach, CA (US)

( * ) Notice: Subject to any disclaimer, the term of this patent is extended or adjusted under 35 U.S.C. 154(b) by 9 days.

(21) Appl. No.: 13/397,357

(22) Filed: Feb. 15, 2012

(51) Int. Cl.

| | |
|---|---|
| ***B25D 1/04*** | (2006.01) |
| ***B25F 1/00*** | (2006.01) |
| ***B26B 3/06*** | (2006.01) |
| ***B26B 1/00*** | (2006.01) |
| ***B26B 3/00*** | (2006.01) |
| ***B25G 1/00*** | (2006.01) |
| ***B25G 1/12*** | (2006.01) |
| ***B25G 3/00*** | (2006.01) |
| ***B27B 21/00*** | (2006.01) |

(52) U.S. Cl.
USPC ..... 7/144; 7/143; 7/146; 7/147; 7/169; 30/151; 30/123; 30/340; 30/342; 30/343; 30/344; 30/514; 30/517

(58) Field of Classification Search
USPC ..... 7/143, 144, 146, 147, 169; 30/151, 30/123, 340, 342–344, 514, 517
See application file for complete search history.

(56) References Cited

U.S. PATENT DOCUMENTS

| | | | | |
|---|---|---|---|---|
| 1,989,225 | A * | 1/1935 | Campbell | 30/342 |
| 3,481,038 | A * | 12/1969 | Cooper | 30/344 |
| 5,630,242 | A * | 5/1997 | Oginaezawa | 7/144 |
| 5,903,942 | A | 5/1999 | Hasegawa | |
| 6,467,114 | B1 | 10/2002 | Sigl | |
| 2006/0080840 | A1 | 4/2006 | Freeman | |
| 2008/0022895 | A1 | 1/2008 | Oki et al. | |
| 2008/0222895 | A1 * | 9/2008 | Marfione et al. | 30/151 |
| 2011/0072705 | A1 | 3/2011 | Simpkins | |
| 2011/0128724 | A1 | 6/2011 | Hung | |

FOREIGN PATENT DOCUMENTS

| | | |
|---|---|---|
| CN | 201415411 | 3/2010 |

* cited by examiner

*Primary Examiner* — Lee D Wilson
*Assistant Examiner* — Danny Hong
(74) *Attorney, Agent, or Firm* — Fulwider Patton LLP

(57) ABSTRACT

A diver's rescue knife including a handle with a threaded stud at the butt end, a hammer screwed onto the stud and mounting a hard pin with a sharp point.

7 Claims, 3 Drawing Sheets

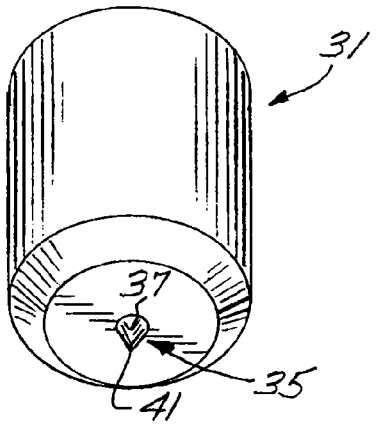
FIG. 3
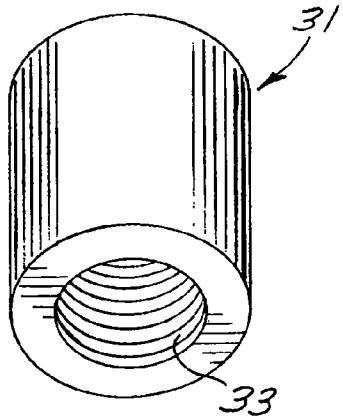
FIG. 4
FIG. 5
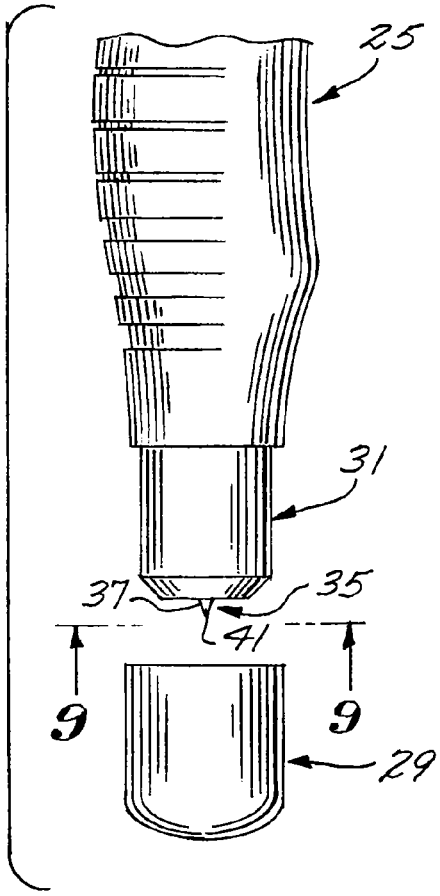
FIG. 6
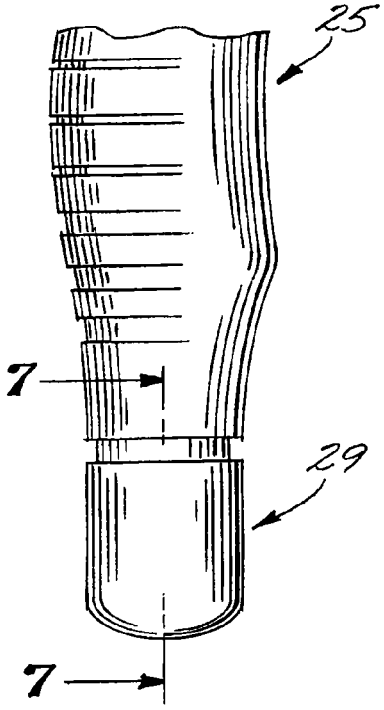

RESCUE PUNCH FOR DIVER KNIFE

BACKGROUND

1. Field of the Invention

The present invention relates to rescue tools and particularly to a divers knife.

2. Description of the Prior Art

First responders to maritime accidents and rescue are typically involved in scuba or free dives to a vehicle or the like which may be submerged in murky water, oftentimes with an occupant having a limited supply of oxygen and sometimes suffering from injury. Popular amongst many such divers are robust diver's rescue knives that typically include a longitudinal blade which may be formed on one side with a sharp edge, on the other side with a corrugated edge and sometimes on the distal extremity with a chisel or pry element. Such knives typically include a relatively robust axial handle and in many instances include a butt end having an axially projecting threaded stud which receives a threaded cap to close off the butt end. Such devices, however, suffer the shortcoming that neither the conventional blade or handle are effective for breaking the glass in a submerged vehicle.

Automobiles and other passenger vehicles are typically manufactured with shatterproof windshields and relatively hard side windows which are challenging to break, particularly underwater where the divers arm movements are resisted by the surrounding water thus dampening efforts to apply a sharp impact to the window area for gaining access.

In many instances, the doors of the vehicles may be damaged and, in any event, for submerged vehicles the water pressure against the exterior of the doors, particularly when multiplied over the total area of the doors, affords a high force resisting swinging of the free edge of the latch edge of the doors outwardly, thereby restricting access. Thus, it is desirable that the diver be equipped with a rescue tool effective to break the glass windows for access to the interior of the vehicle.

In recognition of this need, many different devices have been proposed as a tool for breaking the glass of various windows in the event of an emergency. Typical of these devices are spring loaded keychain devices which may incorporate a spring loaded impact device for striking the surface of a window, various types of hammers and access tools with round or pointed ends for striking the window. Many first responding divers prefer to carry with them a limited number of tools, typically mounted from the belt, arm or other convenient location for ready access in the case of the emergency dive. Most such divers carry with them a rescue knife which is necessary for cutting through various restraints and prying loose different components at an emergency scene.

Multipurpose tools are known in the art. It has been recognized that it would be beneficial to incorporate a punch tool in a rescue knife to thus provide one tool effective to serve the purposes of a knife and a window punch. In this regard various different styles of window punches have been proposed including custom knives which incorporate a punch on the handle end which may be pivoted between retracted and extended positions. Such devices are relatively expensive to manufacture and thus out of reach for many first responders operating on a limited budget. Also, many of these punches suffer the shortcoming that the punches do not include a sufficiently sharp point or sufficiently hard point located on the axis of the knife so that a diver can readily apply a high magnitude of force by quickly grasping the handle and applying a striking blow to a window surface.

It has been proposed to incorporate a window punch in a seat belt cutter to provide a laterally projecting punch. A device of this type is shown in U.S. Pat. No. 5,630,242 to Oginaezawa. Such devices suffer the shortcoming that they have little applicability underwater because sufficient force cannot be applied in the lateral direction to effectively break a typical shatterproof window.

Other devices with the laterally projecting punches include U.S. Pat. No. 5,903,942 to Hasegawa which shows a combination cutter and hammer device.

It has also been proposed to construct a knife which receives a conical cap over the knife and formed with a punch which may be utilized in punching a window. A device of this type is shown in U.S. Pat. No. 6,467,114 to Sigl. Such devices are relatively expensive to manufacture and are typically priced out of the budget of a public employee who would regularly be involved in Harbor Patrol and Coast Guard rescue service.

Other proposals have been made to construct a jackknife with a punch incorporated on one end of the handle. A device of this type is shown in Chinese Patent Publication No. 201415411 published 3 Mar. 2010. Such a foldable jackknives are not generally accepted as readily accessible tools for divers.

Knives have been proposed incorporating various punch devices on the butt end of a knife. In US Application No. 2006/0080840 by Freeman, a knife is disclosed which includes a punch for connection to the butt end of a knife through a relatively complicated connection means. US Publication No. 2008/022895 to Marifone et al. shows a punch at the butt end of a knife which includes a spherical ball for contact with the window.

Thus, until the present invention, rescue divers were faced with a dilemma either invest in a window punch as a separate tool to add to the inventory of devices which must be available on their person underwater, or invest in a new rescue knife with a punch which may be ineffective in many instances to achieve the desired results of effectively shattering the window of a submerged vehicle.

SUMMARY OF THE INVENTION

The present invention includes a hammer formed with an open ended threaded bore for a screwable connection to a threaded stud on the butt end of a divers knife and a hardened pin mounted to such hammer and formed with a sharp hard point for striking the surface of a window.

BRIEF DESCRIPTION OF THE DRAWINGS

FIG. 3 is a bottom perspective view, in enlarged scale, of a hammer incorporated in the kit of the present invention;

FIG. 4 for is a top perspective view of the hammer shown in FIG. 3;

FIG. 5 is a partial exploded side view of the knife shown in FIG. 1 with the hammer of FIG. 3 attached;

FIG. 6 is a side view similar to FIG. 5 with the cap covering the hammer;

DETAILED DESCRIPTION OF THE PREFERRED EMBODIMENTS

Figure 1:
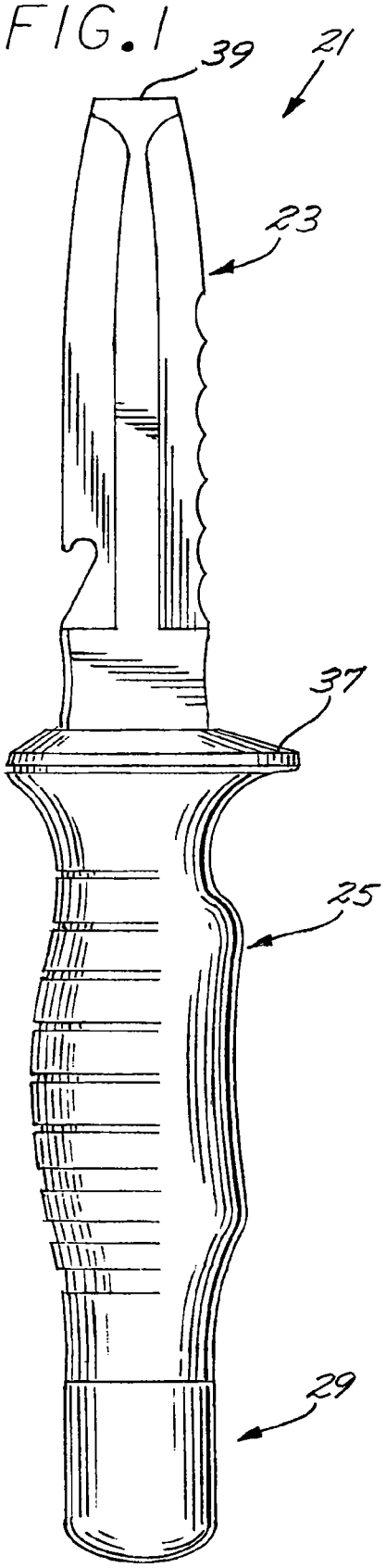
FIG. 1 is a side view of a rescue knife to be converted by the kit of the present invention.
Figure 2:
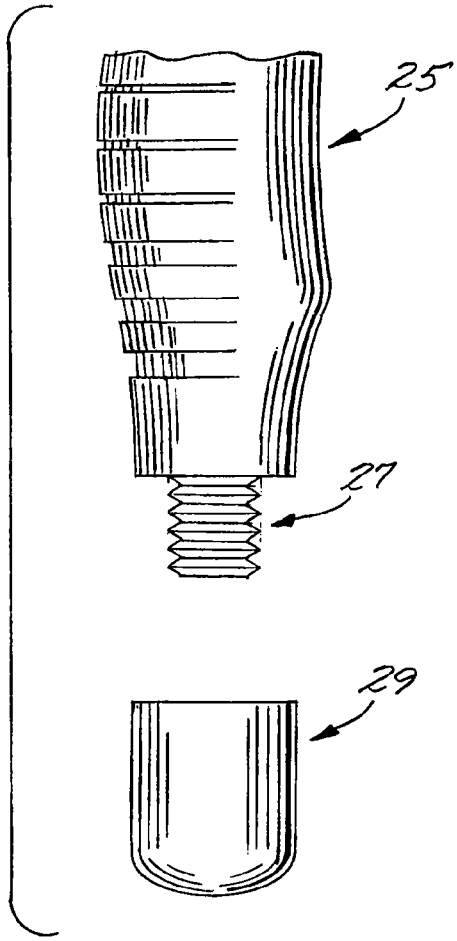
FIG. 2 is a partial exploded view of the butt end of the knife shown in FIG. 1.

The rescue knife window punch conversion kit of the present invention includes, generally, a fixed blade knife 21 having a blade 23 and rigid handle 25 of the type that includes a butt end, configured with a longitudinally projecting axial threaded stud 27 which is typically covered by a butt cap 29. The kit includes a cylindrical hammer, generally designated 31, formed with an open ended threaded bore 33 to fit on the stud 27 and has embedded in the closed end thereof a hard pin, generally designated 35, formed with a conical point 37 disposed in axial alignment with the longitudinal axis so the handle may be grasped for effective purchase in striking an automobile window or the like when in a submerged environment.

In my experience as a first responder diver, I have found that many divers prefer a minimum number of tools with a maximum amount of effectiveness and functionality to thus avoid encumbering their work in the event of an emergency and to simplify access to the tools necessary for a rapid response and rescue mission. In this regard, many first responders prefer working in diving situations with a rigid one piece knife such as that shown in FIG. 1, as available from a number of sources, including Blue Tang Hydralloy Blunt Knife UPC code 32705 30054 available from Underwater Kinetics, 13400 Danielson Street, Poway, Calif. These knives are relatively expensive and provide a robust handle 25 having an effective and relatively large cross sectional gripping area and an enlarged-in-cross section guard 37 at the forward end of the handle to enhance the effectiveness of a user in punching the knife forwardly to, for instance, utilize the blunt tapered blade 39, at the front of the blade itself, as an access or prying tool. Some first responders have been forced to carry on their person, in addition to a knife along the style of that shown in FIG. 1, a punch tool for seeking to gain access to the interior of a submerged vehicle, as by punching against a window surface to break the window and facilitate access. These tools, while available in a wide variety of designs, have the shortcoming that the diver is required to carry at least one additional tool, and in an emergency situation, have access to that tool for gaining access to a submerged vehicle.

I have discovered that it is beneficial for a first responder to have access to a tool which might serve both the function of a knife and pry tool, as well as a punch tool. Experienced divers typically work with a favorite knife design, often introduced during their training periods and typically have a favorite location to holster the knife, such as at the belt level or maybe strapped to the shoulder or arm of the diver's wetsuit or the like. Then, in an emergency situation, the diver will typically respond from his or her training, to access the knife from the familiar location to have ready availability even in the stress of an emergency situation and for use in a situation where time is of the essence.

Since the diver's investment in the knife itself may be considerable, it is beneficial that the conventional rescue knife be readily converted to a combination knife and punch tool without the expense of investing in an entirely new customized tool. In that regard, I have resorted to the expedience of utilizing the stud 35 incorporated on the butt end of the handle 25, typically utilized to mount the butt cover 29.

I have found that a conversion kit may conveniently be utilized to convert the rescue knife to a combination punch and rescue knife tool retaining the benefits of the robust design of the knife and the ergonomic design of the knife handle which facilitates purchase of the user's grip on the handle and the application of forces in a forward thrust of the forearm even in submerged conditions.

My kit includes a dense, cylindrical hammer 31 which I construct of stainless steel, such as 304 SS having a density of about 8000 kg/m$^3$. It is only important that the hammer have sufficient weight and structural integrity to anchor the pin 35 and preferably provide some degree of weight to facilitate the punching action. In one embodiment I have selected a stainless steel having a Brinell hardness of 250.

For the punch pin 35 itself, I have selected a relatively hard material, such as hardened tool steel having a Brinell hardness of 300-700 and in some applications use chromium carbide or tungsten carbide with a Brinell hardness on the order of 1200-1400. Material with such a hardness, while expensive, provides a high degree of strength and resistance to deformation such that the punch pin may be sharpened to a conical point 41 having an included angle of approximately 30° to provide a point of contact for striking an automobile window concentrating all the force of the impact at a single point location and not dispersed along a blade or the like such that the full force of the impact achieves the maximum degree of shock on the window itself. In other embodiments I constructed the punch pin of hard, cold, rolled steel. For the purpose of this application, I intend the term "hard" as it applies to the punch-pin as having a Brinell hardness of at least 300.

Preferably, I construct the hammer with a diameter of one inch and length of approximately one inch. Then, in the closed end of the hammer, I form a bore approximately one eighth inch in diameter and construct the punch pin 35 having an overall length of about three eighths of an inch with the conical point having a length of about one eighth of an inch itself. I adhere the point pin in the bore with an industrial adhesive.

Figure 7:
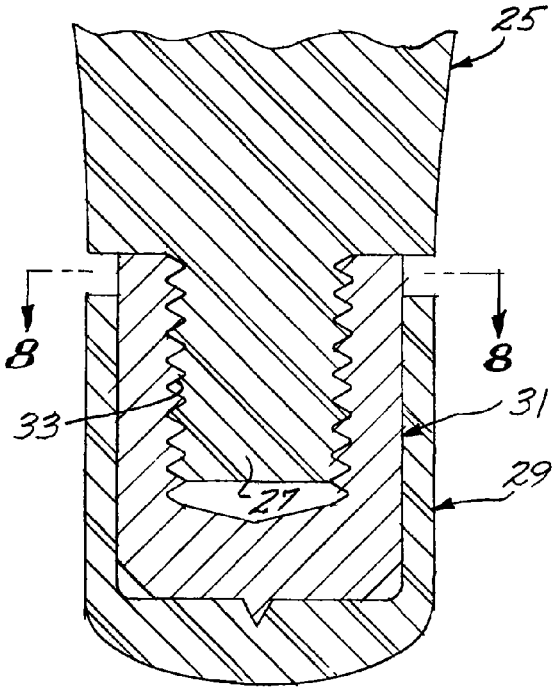
FIG. 7 is a longitudinal sectional view, in enlarged scale, taken from the line 7-7 in FIG. 6.
Figure 8:
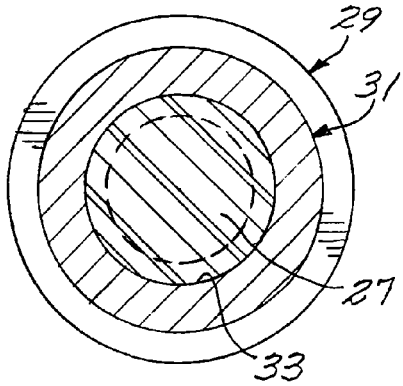
FIG. 8 a is a transverse sectional view taken along the line 8-8 of FIG. 7.
Figure 9:
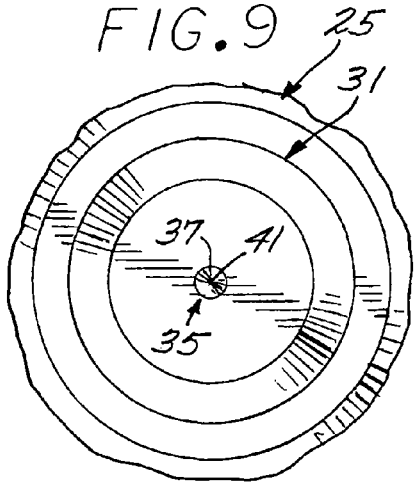
FIG. 9 is a bottom view, in enlarged scale, taken along the line 9-9 of FIG. 5.

In one preferred embodiment, my kit also includes a plastic, cylindrical hammer cover 29 in the form of a closed-end tube having an open-end, sized to be received in friction-fit over the hammer 31 and having a length sufficient to stand the closed-end off the point 41 when fitted on the hammer as shown in FIGS. 7 and 8.

In operation, it will be appreciated that an individual diver or first responder team having the knife of the construction shown in FIG. 1, may, in a relatively inexpensive and convenient manner, convert the rescue knife to a combination rescue knife and punch tool. A relatively unskilled user may thus easily remove the butt cap 29 from the stud and apply the hammer 31 to such stud by means of merely screwing it into place thus positioning the punch pin 35 for ready use. The new hammer cap 29 may then be fitted over the hammer 31 in a friction-fit manner, to protect the point of the punch pin against catching on the wetsuit of the diver or otherwise impinging upon the divers skin or garments.

Then, in the event of an emergency requiring quick action, it will be appreciated that the diver will typically don his or her diving paraphernalia including the strapping of the knife in a familiar place on his or her belt or arm or the like. During the dive it will be appreciated that the diver will locate the submerged vehicle, either by sight or feel, locate the side door and can easily and quickly access the knife to grasp the handle 25 and draw it from the holster and invert the handle in his or her hand to remove the cap 29 and directing the point 41 toward the window surface. Then, with a thrust of a forearm, a diver may drive his or her hand through the water to strike the surface of the window with the sharp hard point 41 thus concentrating the entire force of the blow at a point location on the surface of the window without distribution of the force over any significant area or blunting of the blow by deformation of the point itself or the like. In my various tests of the rescue punch of the present invention I have discovered that it is highly effective to perform the breaking action, all without damage to the punch pin, and serving to quickly and efficiently invade the integrity of the automobile window for breakage and clearing of the window pieces away for entry by the diver to address issues within the automobile, such as incapacitated passengers and the like.

From the foregoing it will be apparent that the kit of the present invention provides for convenient and efficient conversion of a rescue knife to a combination rescue knife and punch tool which is highly efficient in facilitating entry in to a submerged vehicle.

I claim:

1. A rescue knife conversion kit comprising:

an axially elongated rescue knife having a handle with a butt end, including a threaded stud covered by a butt cap;

a hammer formed by an elongated steel tube having a central axis and formed in one end with an open-ended, central, threaded bore to screw onto the stud, and further formed on the closed end;

an axially projecting pin mounted to the closed end and formed with an axially projecting hard point whereby the butt cap may be removed and the hammer screwed onto the stud to dispose the pin in alignment with the axis, whereby a user may grasp the handle to thrust the butt end of the handle toward a window pane to strike the point against the surface of the pane to apply a concentrated force to the pane.

2. The kit of claim 1 wherein:

the point is constructed of cold worked steel.

3. The kit of claim 1 wherein:

the hammer is constructed of stainless steel.

4. The kit of claim 1 wherein:

the point is constructed with a Brinell hardness of at least 300.

5. The kit of claim 1 wherein:

wherein the hammer is constructed with a cylindrical body.

6. The kit of claim 1 wherein:

the pin is constructed with a with a Brinell hardness of substantially 300.

7. The kit of claim 1 wherein:

the hammer includes a bore formed in the closed end; the pin is received in the bore; and an adhesive adhering the tip to the bore.

* * * * *